United States Patent [19]

Pond, Sr.

[11] Patent Number: 4,888,054

[45] Date of Patent: Dec. 19, 1989

[54] METAL COMPOSITES WITH FLY ASH INCORPORATED THEREIN AND A PROCESS FOR PRODUCING THE SAME

[76] Inventor: Robert B. Pond, Sr., P.O. Box 331, Westminster, Md. 21157

[21] Appl. No.: 147,359

[22] Filed: Jan. 21, 1988

Related U.S. Application Data

[63] Continuation-in-part of Ser. No. 17,677, Feb. 24, 1987, abandoned.

[51] Int. Cl.[4] ..... C22C 29/12

[52] U.S. Cl. ..... 75/234; 75/235; 419/19; 419/38; 419/41; 419/67

[58] Field of Search ..... 75/235, 234; 419/19, 419/38, 41, 67

[56] References Cited

U.S. PATENT DOCUMENTS

| | | | |
|---|---|---|---|
| 3,047,383 | 7/1962 | Slayter | 75/201 |
| 3,055,763 | 9/1962 | Kreigh et al. . | |
| 3,110,571 | 11/1963 | Alexander | 29/195 |
| 3,877,884 | 4/1975 | Tawarada et al. | 75/138 |
| 3,888,636 | 6/1975 | Sczerzenie et al. | 29/182 |
| 3,963,449 | 6/1976 | Seki et al. | 29/182.5 |
| 4,193,793 | 3/1980 | Cheung | 75/235 |
| 4,223,075 | 9/1980 | Harrigan, Jr. et al. | 428/610 |
| 4,226,630 | 10/1980 | Styron . | |
| 4,326,579 | 4/1982 | Pond, Sr. et al. | 164/461 |
| 4,370,390 | 1/1983 | Burk | 428/614 |
| 4,409,298 | 10/1983 | Albertson et al. | 428/614 |
| 4,615,733 | 10/1986 | Kubo et al. | 75/229 |
| 4,664,704 | 5/1987 | Dohnomoto et al. | 75/229 |

FOREIGN PATENT DOCUMENTS 1275518 5/1972 United Kingdom .

OTHER PUBLICATIONS

Metals Handbook, 8th Ed., vol. 1, "Properties and Selection of Metals", (1961), pp. 841, 766, 770–772, 774, 415–417, 483–485, 506–508.

Richard A. Flinn and Paul K. Trojan, Engineering Materials and Their Application, Second Ed., (1981), pp. 150–152, 183–188.

Minnick and Baur, "Utilization of Waste Boiler Fly Ash and Slags in the Structural Clay Industry", American Ceramic Society Bulletin, vol. 29, No. 5, pp. 177–180, (1950).

B. Baudelet, "La Superplasticite et la mise en Forme des materiaux", Memoires Scientifiques Revue Metalurgie, LXVIII. No. 7–8, (1971), pp. 479–487.

B. Baudelet, "Technology of Superplastic Materials", Memories Scientifiques Revue Metallurgie, Feb. 1972, pp. 101–110.

*Primary Examiner*—Stephen J. Lechert, Jr.

*Attorney, Agent, or Firm*—Oliff & Berrridge

[57] ABSTRACT

The invention is directed to a process for producing metal composites from low-cost earth products and articles manufactured thereby. Fly ash from burned coal and oil is bonded with low-melting metals or alloys to produce economical composite materials with modified strength, conductivity and wear resistance.

21 Claims, 8 Drawing Sheets

METAL COMPOSITES WITH FLY ASH INCORPORATED THEREIN AND A PROCESS FOR PRODUCING THE SAME

BACKGROUND OF THE INVENTION

This application is a continuation-in-part of U.S. patent application Ser. No. 017,677, filed Feb. 24, 1987, now abandoned.

FIELD OF THE INVENTION

This invention relates to the field of structural and ornamental composite materials, wherein unusual properties of strength, conductivity and wear resistance are exhibited relative to a matrix material alone.

DESCRIPTION OF THE PRIOR ART

The field of metal-metal compound composites has been explored in detail. Metal compounds finely dispersed in metal matrices provide the basis for some of the most advanced high-tech materials today, e.g., carbon-aluminum alloys, metal carbide hardened steels, precipitation hardened steels, precipitation hardened aluminum alloys and copper alloys—Metals Handbook Vol. 1, 8th Edition 1961. The techniques for dispersing one compound within another are well known, and generally consist of precipitation techniques from liquid or solid solutions. An example of a material formed according to these techniques is the copper—copper oxide alloy wherein the oxide may be a primary crystallization product of a eutectic dispersion. See "Engineering Materials and their Applications"—R. A. Flinn and P. K. Trojan—Houghton-Mifflin Co., Boston, 1981. Other high strength metal-ceramic composites are generally manufactured by infiltration of the liquid metal around the ceramic particles or by mechanical incorporation of the ceramic material into the metal matrix by powder metallurgical processes, such as mixing, compressing and sintering powder blends, or by liquid phase bonding.

However, these high-tech materials are generally very expensive due to the complicated processes involved, along with the high cost of the ceramic materials used in the composite. Accordingly, the need exists for producing metallic composite materials which are substantially equivalent to or superior to the prior art composite materials, in a more economical fashion.

SUMMARY OF THE INVENTION

The present invention relates to a process for manufacturing less expensive metal composites with fly ash, and metal composites produced thereby. By incorporating fly ash into a metal matrix to form a less expensive metal composite with substantially all of the attributes of its more expensive counterpart, the metal composites produced according to the present invention offer an economical alternative to the heretofore known metal composites.

Accordingly, it is an object of the present invention to produce a less expensive metal composite from fly ash.

Another object of the invention is the manufacture of a less expensive metal composite having substantially improved properties over the matrix and having substantially equivalent or superior properties to its more expensive counterpart without fly ash incorporated therein.

Another object of the invention is the utilization of an economical process to produce the aforementioned metal composites, which metal composites then may competitively interact on the market as a substitute for the more expensive counterpart.

Another object of the invention is the utilization of fly ash which is generally disposed of or used as landfill, etc.

DETAILED DESCRIPTION OF THE DRAWINGS

FIGS. 1–8 graphically illustrate the data set forth in Table I below. The various data points are defined in FIG. 1, and further defined throughout the other figures where necessary.

Figure 1:
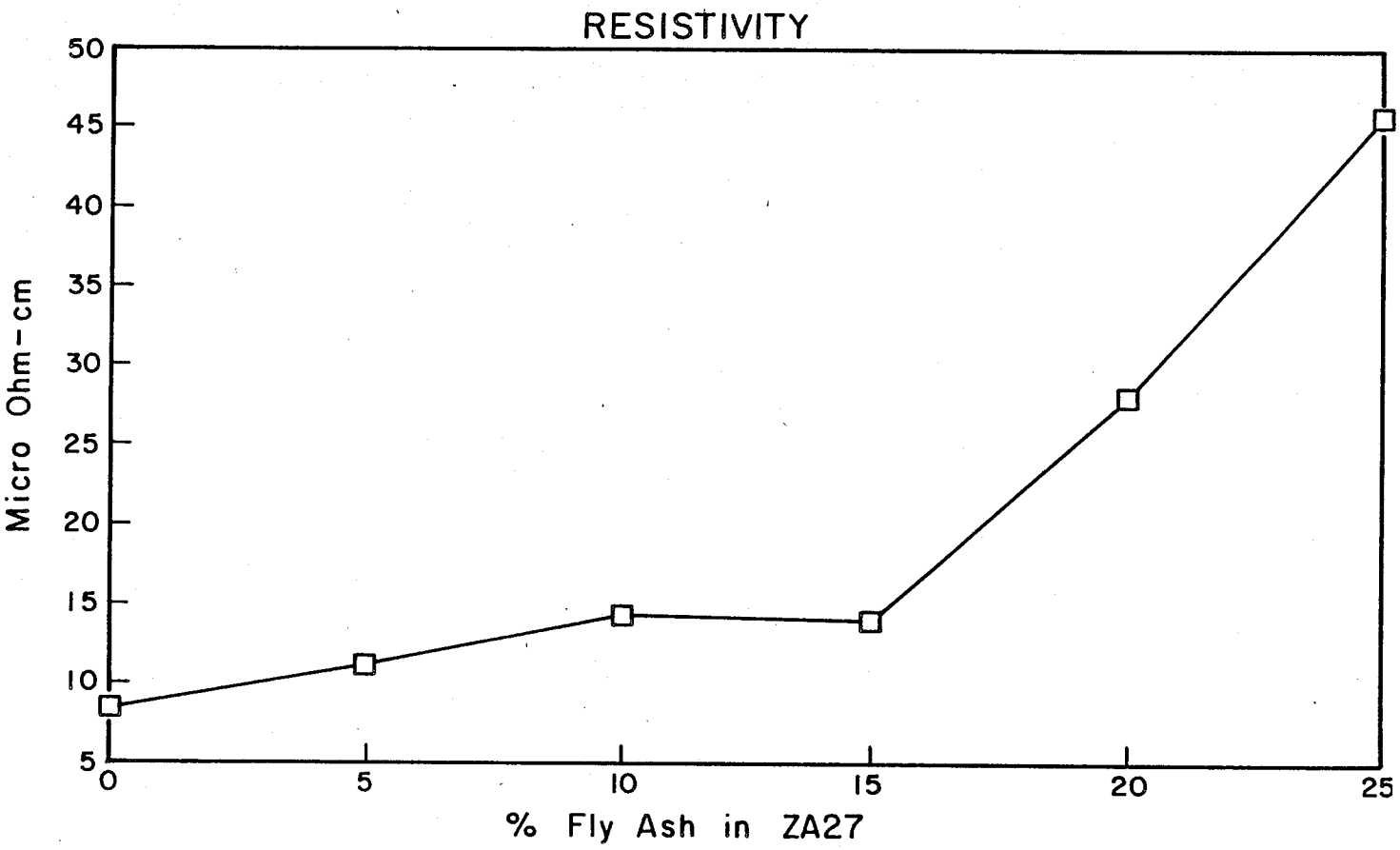
FIG. 1 is a graph of the resistivity of the metal composites produced according to the claimed invention.
Figure 2:
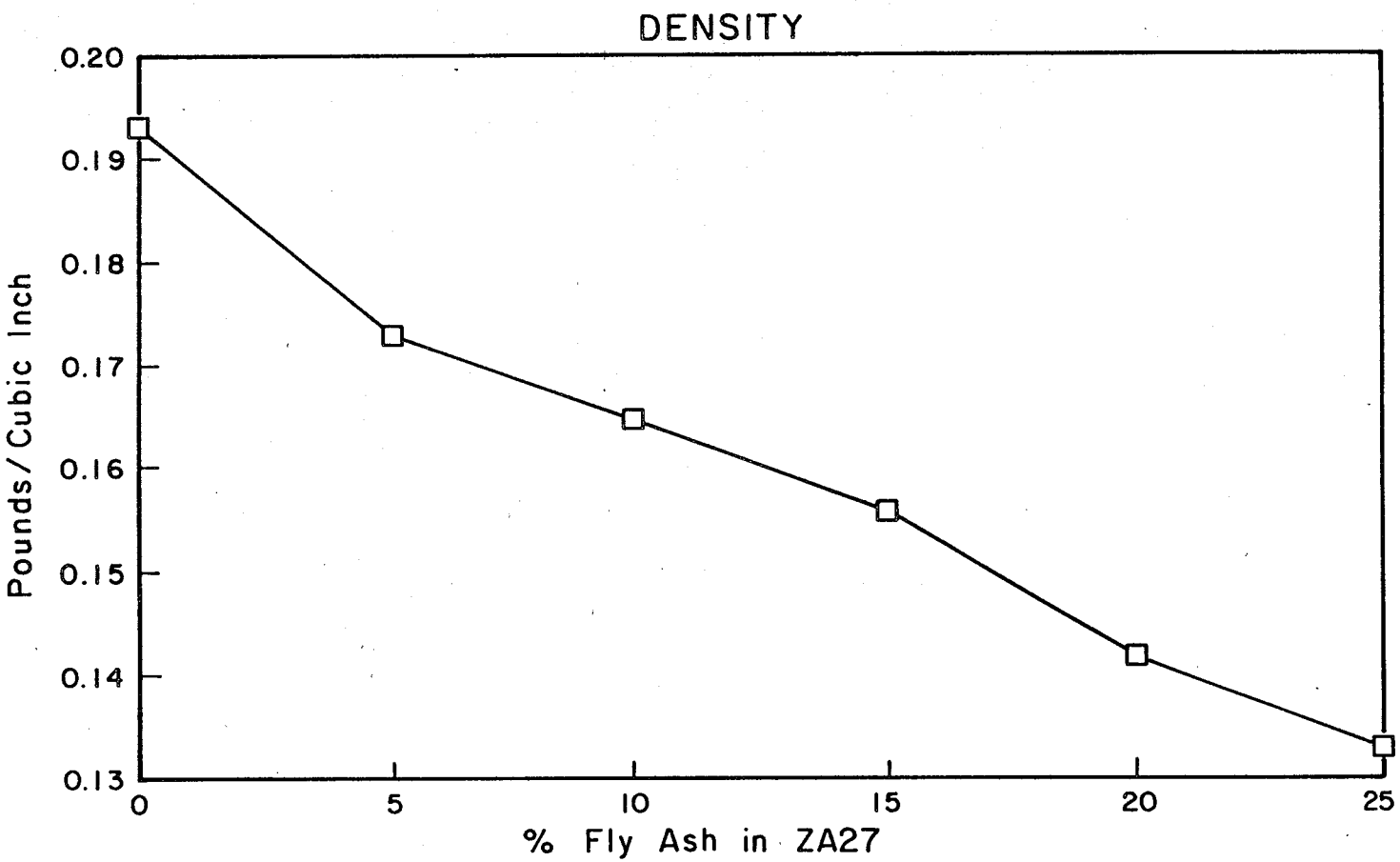
FIG. 2 is a graph of the density of the metal composites produced according to the claimed invention.
Figure 3:
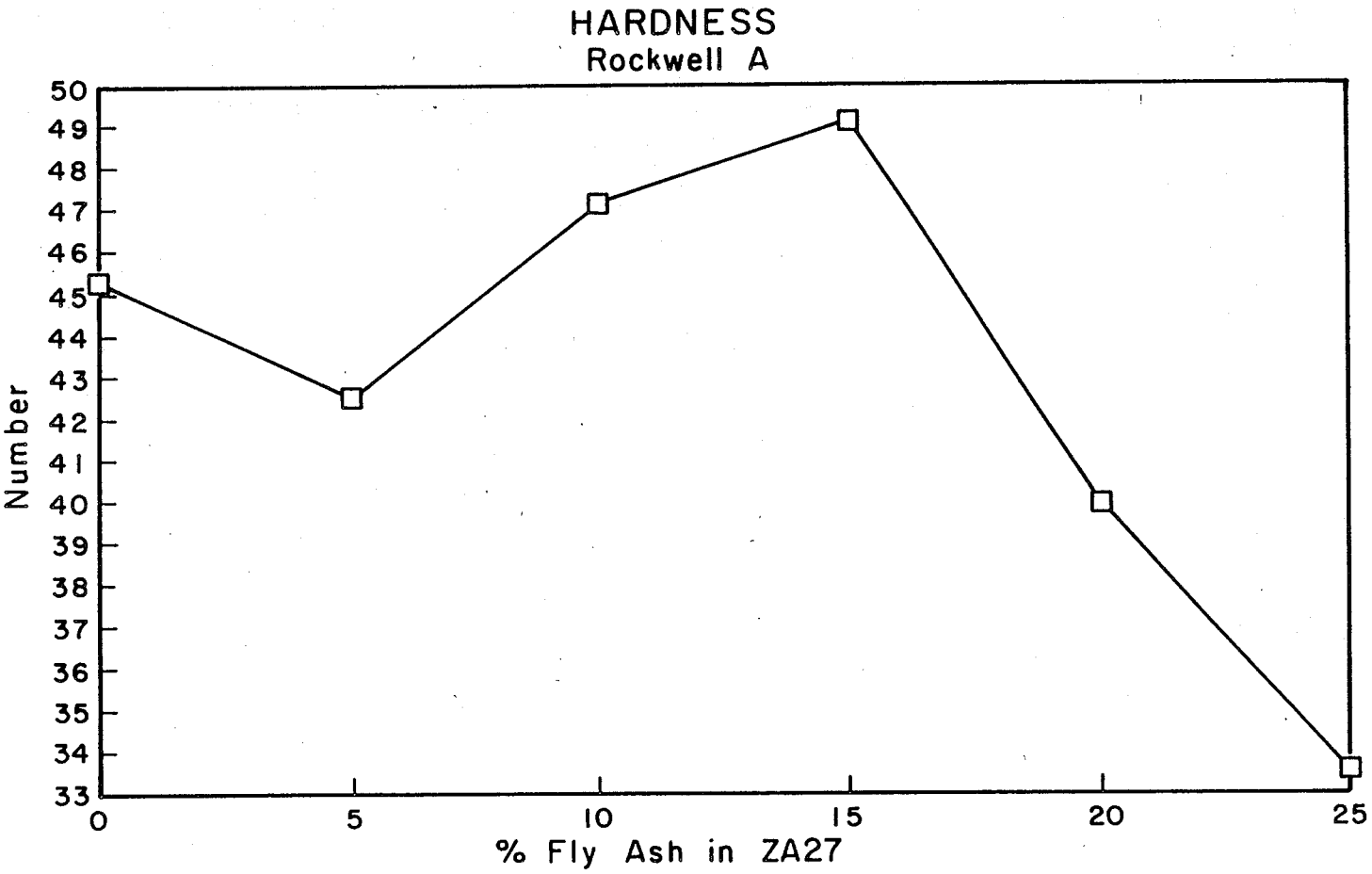
FIG. 3 is a graph of the Rockwell A hardness measurement of the metal composites produced according to the claimed invention.
Figure 4:
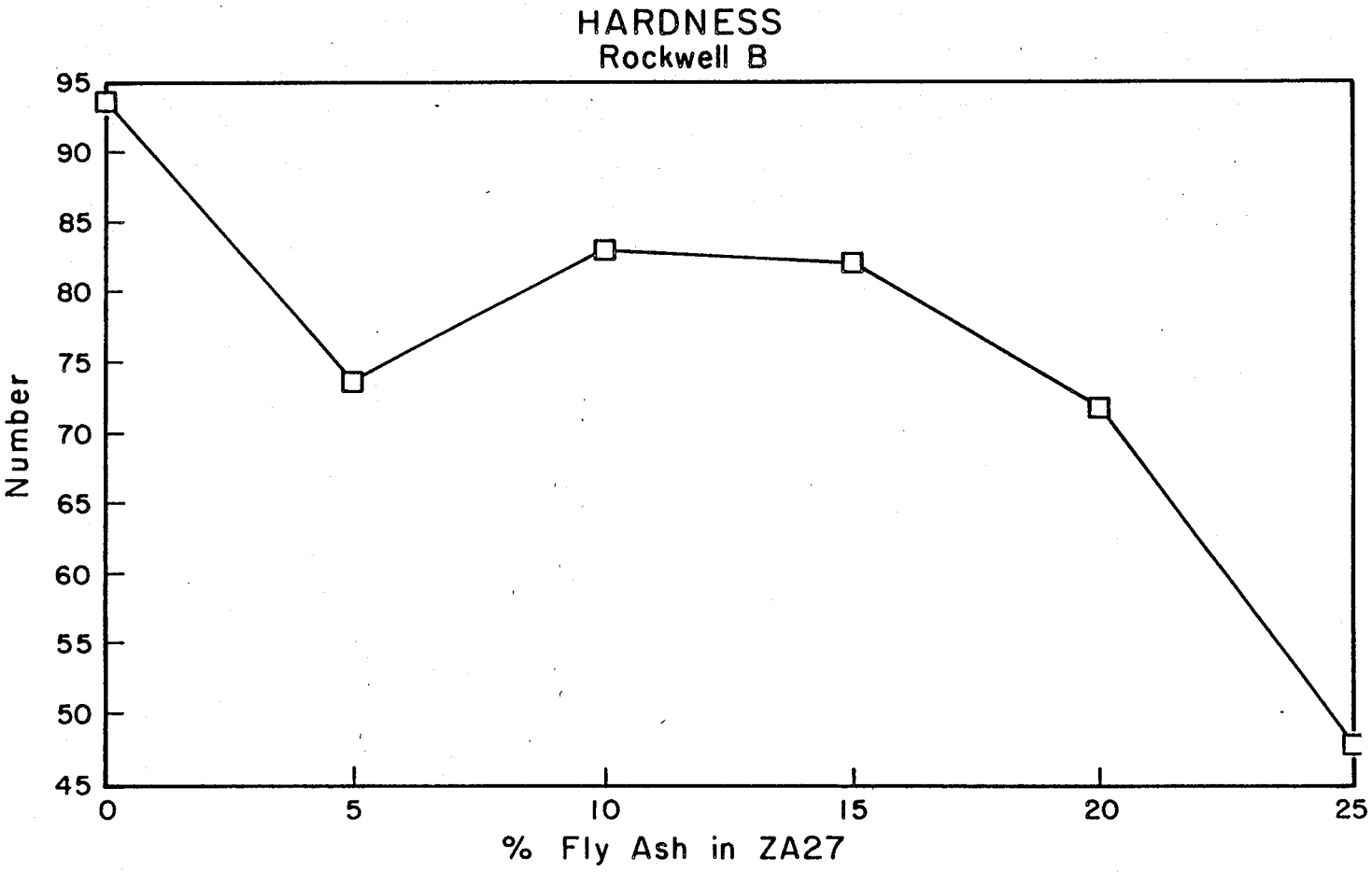
FIG. 4 is a graph of the Rockwell B hardness measurement of the metal composite produced according to the claimed invention.
Figure 5:
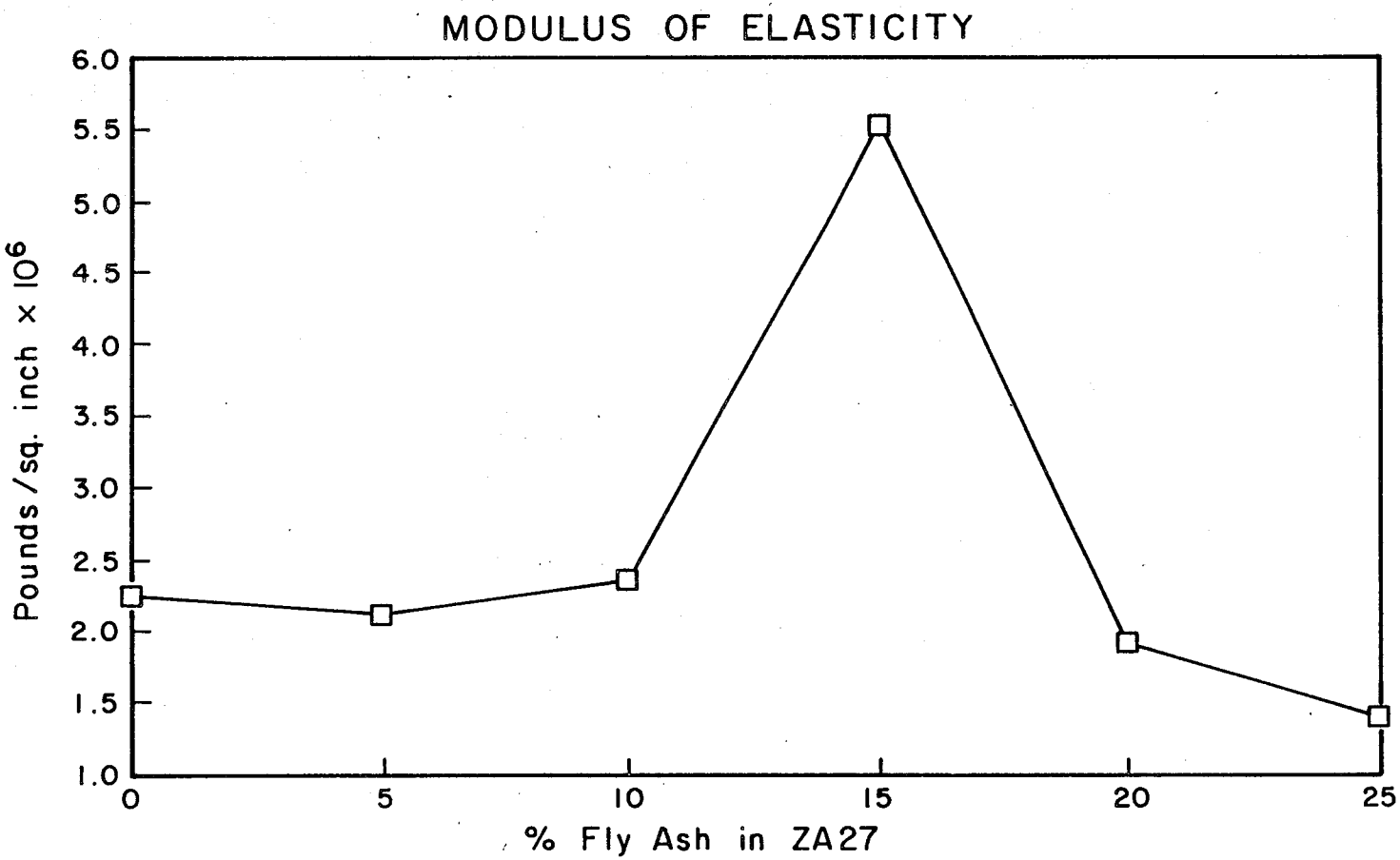
FIG. 5 is a graph of the modulus of elasticity of the metal composites produced according to the claimed invention.
Figure 6:
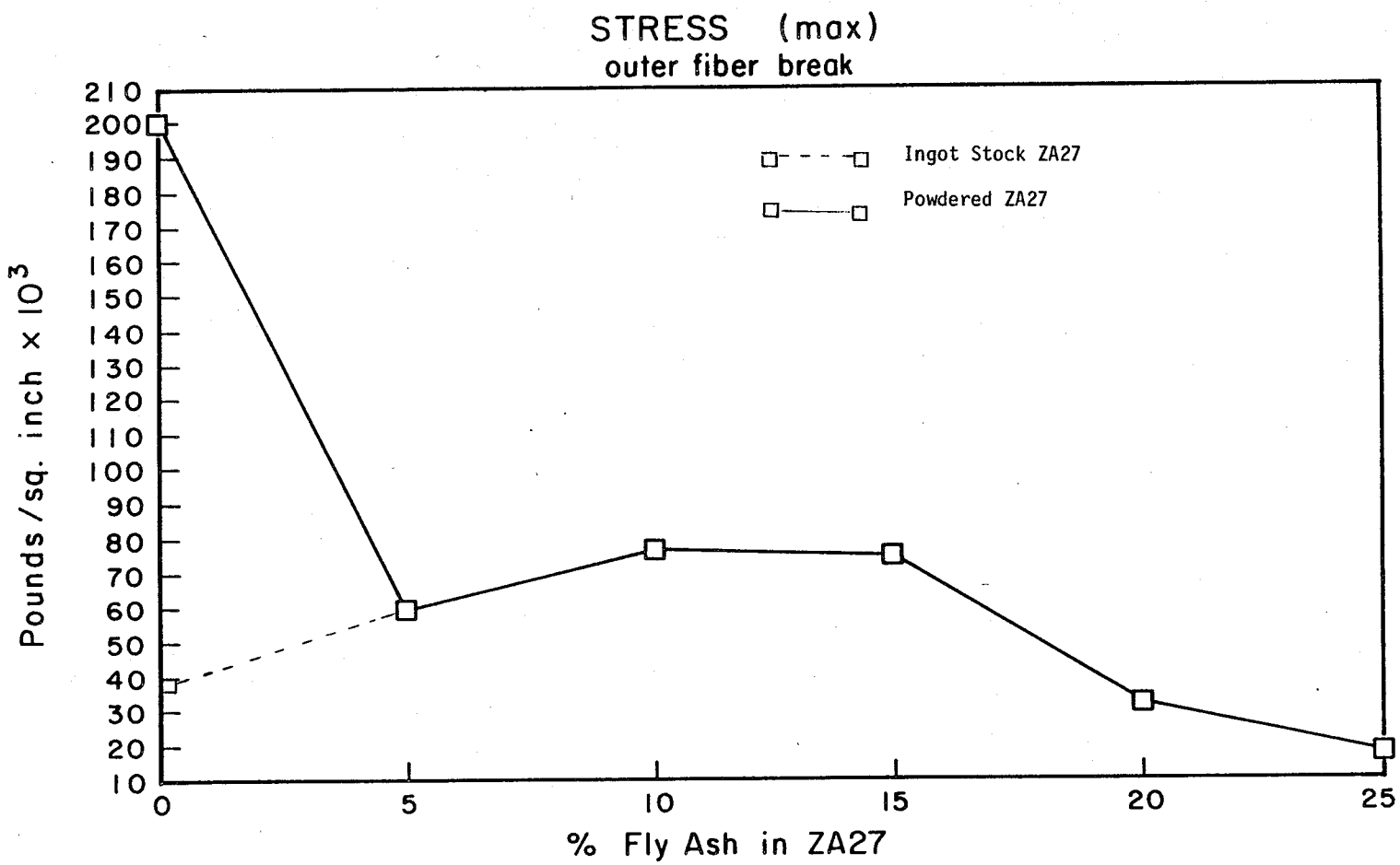
FIG. 6 is a graph of the fracture stress (max) of the metal composites produced according to the claimed invention.
Figure 7:
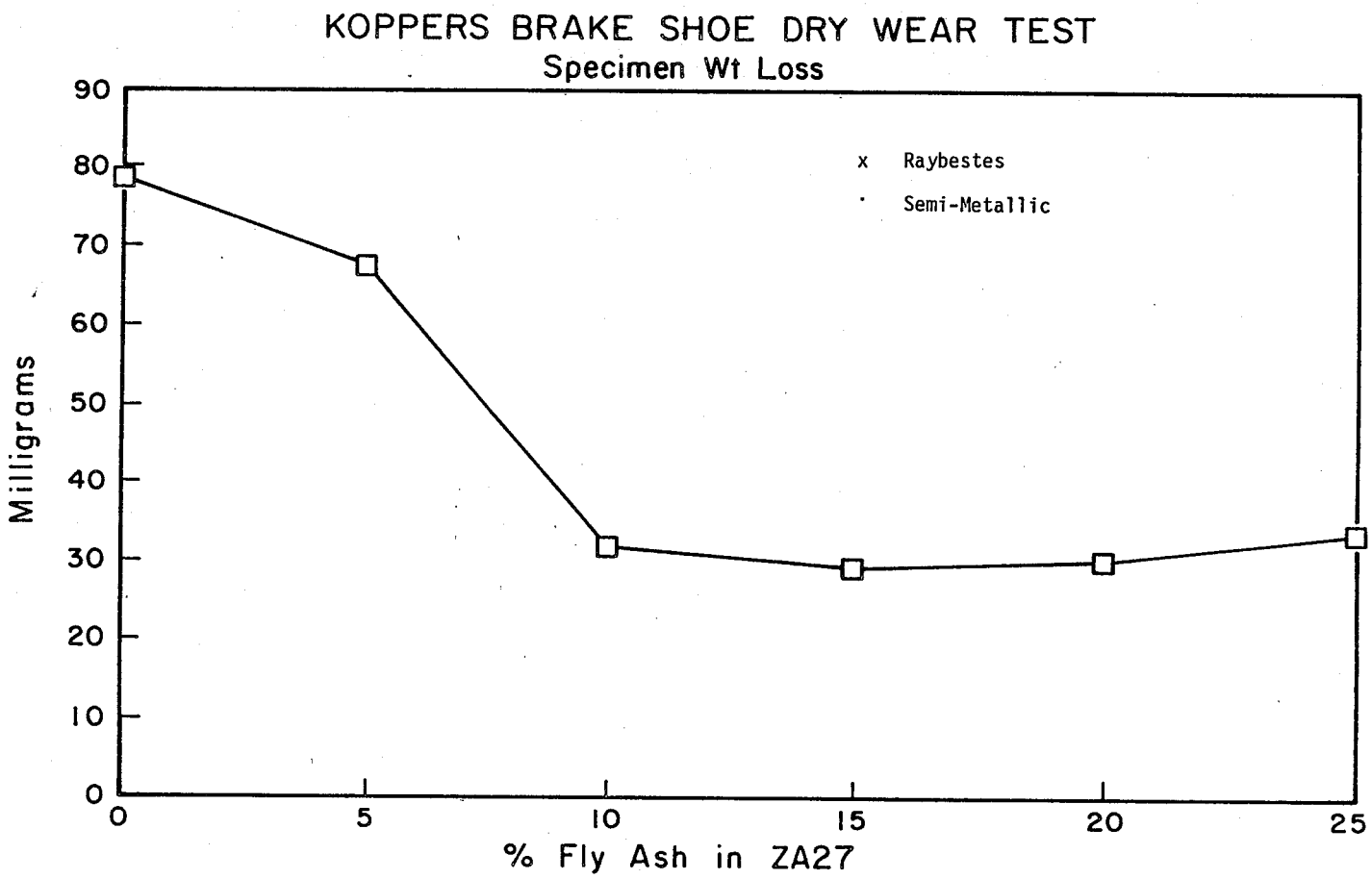
FIGS. 7 and 8 are graphs of the results of wear tests performed on metal composites produced according to the present invention.
Figure 8:
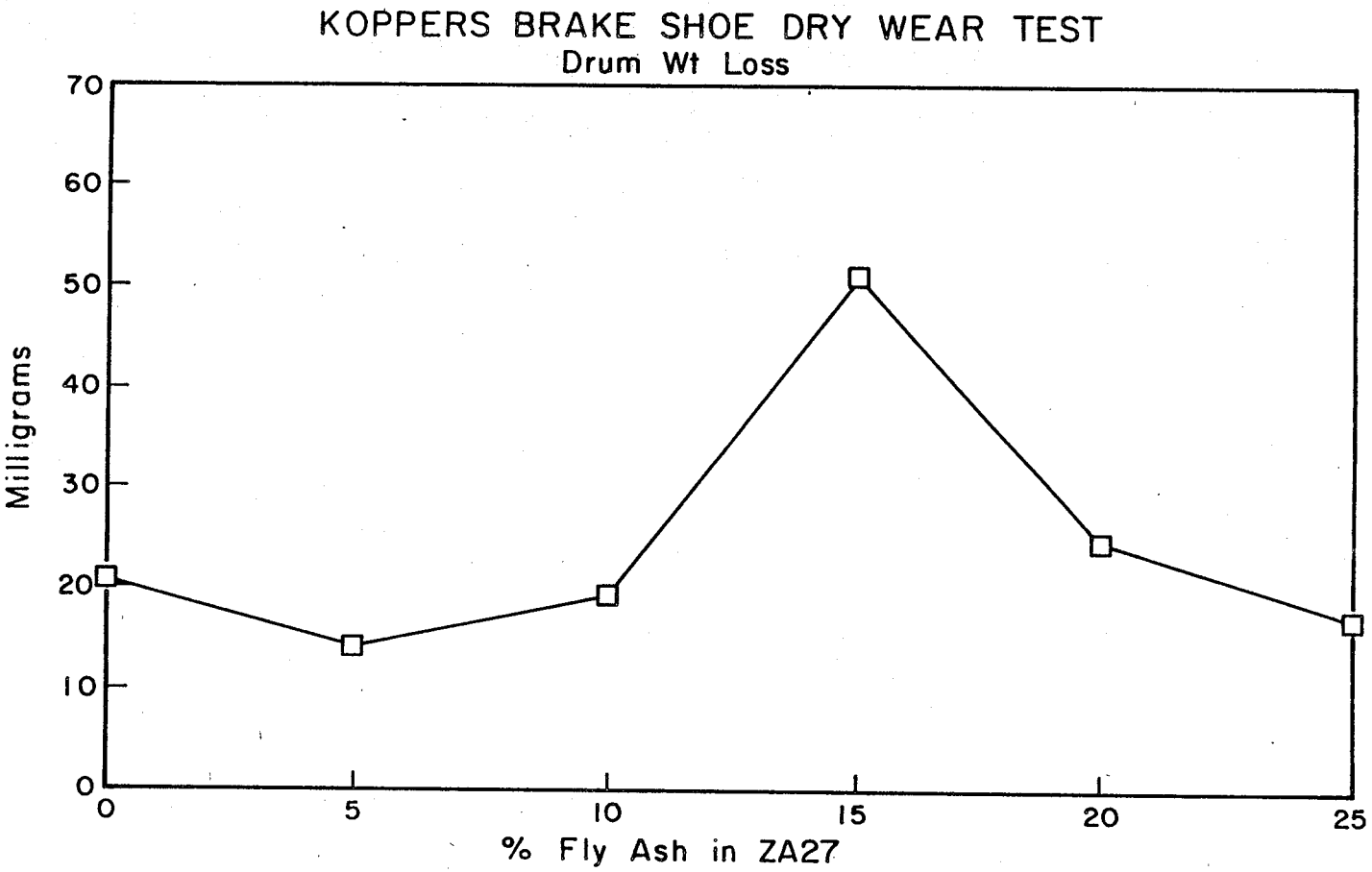

According to FIG. 6, the maximum fracture stress of a metal product with zero weight percent fly ash incorporated therein changes significantly depending upon whether the product is formed from powdered ZA-27 or ingot stock ZA-27. FIGS. 7 and 8 illustrate the results obtained from a Koppers Brake Shoe Dry Wear Test with specimen and drum analysis, respectively. The wear tests determine the weight loss from the specimen as well as the brake drum, and are compared against industry standards such as Raybestes and semi-metallic materials. The data points set forth in FIGS. 1–8 generally correspond to data acquired in accordance with a first embodiment of the present invention, discussed infra.

The figures are intended for illustration purposes only; no one figure in and of itself manifests the patentable subject matter of the present invention. The figures illustrate how the physical properties of a metal composite may be varied according to the amount and type of fly ash incorporated therein. One of ordinary skill in the art would recognize that the physical properties of the composite metal material according to the claimed invention may be optimized as a direct function of the intended result. For example, the graph in FIG. 5 illustrates that the modulus of elasticity is at a maximum for 15% fly ash by weight in ZA-27.

Mechanical design considerations, namely, the elastic limit and Young's Modulus of elasticity, of the material make evident the fact that the composite material produced according to the claimed invention may possess higher mechanical design limits than a product produced from pure metal matrix material. The modulus of elasticity data in FIG. 5 for the various compositions suggest that a metal composite having superior mechanical design limits may be selected by optimizing the fly ash content. All mechanical tests were conducted according to well known techniques in the industry.

DESCRIPTION OF PREFERRED EMBODIMENTS

The present invention relates to a process for manufacturing inexpensive metal composites with fly ash incorporated therein, and products obtained thereby. The metal composites produced according to the present invention have a readily available, low-cost earth product incorporated into their matrix system which advantageously improves their economic worth over other heretofore known metal composites without affecting deleteriously the composites' physical properties of interest.

An important aspect of this invention lies in the recognition of a unique property of fly ash which exhibits itself when it is heated in the presence of a metal matrix.

Fly ash consists primarily of iron oxide, aluminum oxide and silicon oxide with several extraneous impurities. It is recognized as being vitreous and the iron as being in the ferrous state which at elevated temperatures changes to the ferric state by oxidation. (See "Utilization of Waste Boiler Fly Ash and Slags in the Structural Clay Industry" by Minnick and Bauer, American Ceramic Society Bulletin, Vol. 29, No. 5, pp. 177–180 (1950). This requirement for oxygen institutes a competition for the oxygen in oxide films of dispersed metal particles and thereby generates "Reaction type" bonds between the fly ash and the metal. A further reaction occurs if the matrix contains metals which will involve a thermit reaction with the iron oxides. In this case the metal reduces the iron oxide toward elemental iron which may dissolve in the metal matrix but which is generally tied up in a new, hard, strong phase resulting from the reaction.

If the reacting metal was aluminum, the difference between the heat of formation of aluminum oxide (392,600 calories) and iron oxide (−197,000 calories) is 195,600 calories. However the process will operate with any metal having a heat of oxide formation greater than that of iron oxide.

Since fly ash consists primarily of the oxides of iron, aluminum and silicon, it is reasonable to suspect that any aluminum in the metal matrix of the composite product will react with the silicon oxide as well as the iron oxide since the heats of formation for silicon oxide vary from 202,500 calories for vitreous silica to 209,400 for tridymite, 209,500 calories for cristobalite, and 209,900 calories for quartz. In this instance the reduced silicon may dissolve in the metal matrix, but is also generally tied up in the new phase resulting from the reaction.

Therefore as the ash-metal blend (which is consolidated to have the minimum voids between the particles) is heated, the high oxidization energy metal such as aluminum, magnesium, titanium, etc. not only tends to weld or sinter together but also engages in a thermit type reaction with the fly ash. The degree to which this reaction approaches completion is dependent on factors such as ash content, particle size and distribution and temperature.

The usefulness of the metal composite materials according to the invention may sometimes be a function of the ability of the materials to be shaped. In the situation where the article of manufacture is to be utilized in its original shape, without further forming, the primary importance then is focussed on the fly ash such as from the burning of coil or oil. The metal matrix material is of secondary importance. The metal matrix material of the metal composite may be any number of metals or metal alloys, including the metal alloy ZA-27. One of ordinary skill in the art recognizes ZA-27 as an alloy consisting essentially of 27% by weight aluminum and 73% by weight zinc. Other suitable metal matrix materials include alloys of aluminum, tin, zinc, and copper.

When the metal composite is produced in a convenient shape and is subsequently pressed, rolled, stamped, extruded, machined or otherwise formed, the metallic matrix material chosen should be one which inherently possesses good formability. Such a metallic material may be inherently malleable or may be made malleable by transforming it into a superplastic state. Although there are many superplastic alloys, virtually all metal eutectics or ductile metals with grain sizes less than 10 microns are superplastic. This vast array of possibilities is presented by B. Baudelot in "A Review of Super Plasticity" in Memoires Scientifiques Revue Metallurgia 1971, pp. 479–487. For purposes of illustration of the present invention, only the monotectoid of Al-Zn (ZA-27) was examined. A skilled artisian will readily recognize that numerous other superplastic alloys can be substituted for the Al-Zn alloy.

A first embodiment for manufacturing metal composites with fly ash incorporated therein comprises mixing a predetermined amount of the fly ash with a desired powdered metal matrix material to obtain a homogeneous powder mixture, compressing the mixture to produce a compact, heat treating and further compressing the compact to form bonds between the metal matrix material and the fly ash, as well as within the fly ash and within the metal matrix material thereby obtaining the ultimate metal composite. Each one of the above processing steps will be described in greater detail below.

Initially, before processing begins, the particle sizes of the powdered metal matrix material and fly ash must be selected. Although the particle sizes of the fly ash will generally be determined by how that product is found in nature (without further processing, such as grinding), the ratio of the particle sizes of the metal matrix material to the fly ash may be anywhere from 10/1 to 1/10, preferably between 5/1 to 1/5, most preferably being approximately 1/1. It has been found that a ratio of 1/1 generally produces better blends of materials, resulting in a more homogeneous mixture. Particle sizes of both the metal matrix material and the fly ash should preferably be in the range of approximately 1 to 100 μm. Both the particle ratio and particle size affect the continuum of the metal composite. Both a ratio closer to 1/1 and smaller particle sizes produce a greater continuum in the metal composite.

Once the particle sizes have been selected, the amount of fly ash to be mixed with the metal matrix material should be determined. Anywhere from 1 to 40% by weight of fly ash based on the amount of metal matrix material, preferably between 5 to 25%, may be used. If less than 1% of the fly ash is used the economic benefits heretofore discussed are not recognized. Anywhere above 40% produces a product more properly described as a ceramic composite.

Once the particle sizes and compositional amounts have been determined, the metal matrix materials and fly ash are mixed to form a homogeneous mixture. The mixing may be accomplished by well known techniques to those skilled in the art. It has been found that ball-milling gives the most efficient results. The length of time required to form a homogeneous mixture will depend generally upon the size of the grinding media in the ball-mill, the volume capacity of the ball-mill, as well as the efficiency thereof, all of which are within the knowledge of one having ordinary skill in the art.

Once a homogeneous mixture has been obtained, a portion thereof is placed in a die assembly and cold pressed at a pressure of between 10,000–50,000 lbs/in$^2$, preferably between 20,000–30,000 lbs/in$^2$. However, the amount of pressure applied is limited only by the amount of pressure that the particular die assembly can withstand. Accordingly, pressures as high as 100,000 to 150,000 lbs/in$^2$ may be applied. Generally, 10,000–50,000 lbs/in$^2$ have been determined to be satisfactory. Upon completion of this step there is obtained a compact of a metal matrix/fly ash, said compact being ready for heating.

The compact is now ready to be heated according to one of two methods. The first method requires heating the compacted material to just below the solidus temperature of the metal matrix material and subsequently pressing the same at a pressure in excess of the plastic flow stress of the metal at this temperature. Obviously, this pressure will be determined by the composition of the metal matrix material used and is readily determined by a skilled artisan. This process is known to those skilled in the art as hot coining. This particular heating and pressing step forms the bonds between the metal matrix particles, between the fly ash particles and between the fly ash particles and the metal matrix particles, thereby forming a solid metal composite. This composite can have a metal matrix which is modified by elements reduced from the fly ash by the bonding reaction as well as an identifiable reaction phase which is the result of the bonding mechanism. One of ordinary skill in the art would also recognize that this step may be adapted easily to the production of a metal composite by way of a hot extrusion process, i.e., once the metal matrix material is heated to just below its solidus temperature, the compacted homogeneous mixture could be subsequently extruded through a small opening to produce a metal matrix in the form of a wire, bar, sheet or other form.

An alternative to the above heating step would be to heat one of the phases (the metal matrix or the fly ash) to just above its solidus temperature and apply a pressure just below that pressure where molten metal would be ejected from the die. Obviously, the pressure will also depend entirely upon the type of die system utilized. However, this pressure must be at least 4,000 lb/in$^2$. As with the case above, the produced metal composite will have the particles of dispersed fly ash bonded to the particles of the metal matrix material and with each other, thereby forming a metal composite having the desired physical character.

The choice of which heating step to use will depend upon the relative melting temperatures of the matrix alloy and the filler material and upon subsequent shaping operations (i.e. leave in compressed form or produce a different form by mechanical deformation).

According to a second embodiment of the invention, a homogeneous mixture of particles of the fly ash and powdered metal matrix material is heated, without initially being compacted, until the metal becomes molten. Both the particle size selection of the fly ash and metal matrix material, as well as the mixing procedure for obtaining a uniform homogeneous mixture, are as described hereinabove.

Because of the formation of an oxide film on the metal matrix material particles, the mixture remains in a powder form even though the metal is in its molten state. Accordingly, particles of fly ash are interdispersed throughout the molten metal matrix material particles.

The homogeneous mixture then is fed continuously to a forming operation, such as chill block melt extraction (as described in U.S. Pat. No. 4,326,579), a pair of nip rollers, pressing, stamping, extruding, etc., to be formed into a bar, rod, sheet, wire and the like. Of course, further refining of the thus formed material may be performed according to any of the well known methods.

A modification of this embodiment is found in spray coating by feeding of the homogeneous mixture of particles of the fly ash and the powdered metal matrix material through a high temperature flame source such as a Metco Spray Gun or a plasma spray gun whereby molten particles of the fly ash as well as molten particles of the metal matrix material are simultaneously projected against immobile objects to build up volumes of fly ash homogeneously dispersed in a metal matrix.

Unlike the first embodiment, where the material must first be compacted prior to the heating step (a batch operation), this embodiment permits the utilization of a continuous process which in turn significantly reduces costs and facilitates large scale development and production.

In addition, chill block melt extraction, unlike the other forming operations, does not require the high static pressures normally associated with pressing, rolling, stamping, extruding, etc., as described above (required to effect bonding), which static pressures act to break the surface tensions of the individual particles, thus creating the bonds within the finished metal composite. Instead, the pressure is kinetic in nature, arising from the shearing stresses acting on the homogeneous mixture. The shearing stresses act to break the surface films of the individual particles, thus facilitating the creation of bonds in the final product.

In a third embodiment, metal ingots of the metal matrix material (nonpowdered) are heated to the liquid molten state and the fly ash is then mixed into the molten liquid to form a uniform homogeneous mixture of fly ash dispersed within the molten metal matrix material. This embodiment of the invention also permits utilization of a continuous process with all of the benefits associated therewith. For example, the molten mixture may be subjected to chill block melt extraction to be formed into a bar, sheet, rod, etc. Alternatively, the molten mixture may be subjected to hot isostatic forming of billets with subsequent swaging, rolling or other shaping taking place. As may be expected, the billet will undoubtedly require further heat treatment prior to further processing.

Unlike the first embodiments, this particular embodiment does not necessitate the selection of a particular ratio of particle size of the metal matrix material to the fly ash, since the metal matrix material is initially in ingot or block form and subsequently heated to its liquid molten state. The fly ash particles are subsequently mixed by any well known method into the liquid molten metal matrix until a uniform homogeneous mixture of fly ash particles evenly dispersed throughout the molten liquid is obtained. However, particle sizes of the fly ash should remain between 1 and 100 μm to ensure that the final metal composite has a uniform structure.

The following examples are intended for purposes of illustration only, and are not to be construed as limiting the scope of the claimed invention.

EXAMPLE 1

Al-Zn alloy powders having an aluminum content of 27% by weight (ZA-27) are intimately mixed with fly ash powder in concentrations of 5 weight percent, 10 weight percent, 15 weight percent, 20 weight percent and 25 weight percent, respectively based on the weight percent of the Al-Zn alloy. The mixtures are compressed in the dry state at pressures of up to 15,000 Psi, then brought to a temperature of 400° C. which is just below the solidus temperature for the alloy. The heated mixtures are then compressed at 20,000 Psi to produce articles which are dense and have strength, conductivity and wear properties which all depend upon the fly ash/metal ratio. These materials are inherently brittle, but by quenching the article from above 275° C. they are rendered ductile with the degree of ductility dependent upon the ash/metal ratio. The metal matrix material to fly ash particle ratio for the above mixtures is in the range of between 10/1 to 1/10.

EXAMPLE 2

The process of Example 1 is substantially repeated but with ZA-27 being replaced with aluminum, tin, zinc, aluminum bronze and copper. The fly ash content is held constant at 15% by weight. The solidus temperture of the specific metal changes accordingly, with the remaining process parameters staying constant.

EXAMPLE 3

For purposes of comparison, two control samples were produced. Control 1 consisted of pure ZA-27 initially in powder form (which has an inherent $Al_2O_3$ film on the ZA-27 particles and a monotectoid interior). Control 2 consisted of pure ZA-27 initially in ingot stock form. Control 1 was produced according to the method of Example 1. The data for the above Examples is set forth below in TABLE 1 and graphically in FIGS. 1–8.

EXAMPLE 4

Al-Zn, aluminum, tin and zinc metal matrix materials in powdered form are uniformly mixed with fly ash, in various combinations of between 5 and 25% by weight based on the metal matrix material. The resulting homogeneous mixture is subsequently heated to the metal's molten state temperature and the heated mixture may then be continuously formed by one of the methods listed herein into a sheet, bar, rod, wire or the like. The resulting products have strength, are dense and have conductivity and wear properties which all depend upon the content of the fly ash. The particle size ratio is between 10/1 and 1/10.

EXAMPLE 5

Al-Zn, aluminum, tin and zinc metal matrix materials in ingot or block form are heated to their molten state and are mixed with fly ash in various amounts of between 5 and 25% by weight based on the metal material, to obtain a homogeneous mixture of fly ash dispersed throughout the molten liquid metal. The resulting mixture is then continuously formed into billets which are then subject to swaging, rolling or other shaping, or the hot molten mixture may be continuously fed to a chill block melt extraction process to form, bars, sheets, rods and the like.

As with the above Examples, the formed product has physical properties which vary according to the low cost earth product content.

TABLE I

| Low Cost Earth Material | Metal Matrix Material | Composition(1) | Resistivity (micro ohm-cm) | E(2) (lb/in²) | Hardness(3) R-A | Hardness(3) R-B | S(max)(4) (lbs/in²) | Density (lbs/in³) |
|---|---|---|---|---|---|---|---|---|
| Fly Ash | ZA-27 | 5 | 11.2 | 2,122,852 | 42.5 | 73.7 | 59,330 | 0.172847 |
| Fly Ash | ZA-27 | 10 | 14.4 | 2,357,900 | 47.1 | 83.0 | 76,673 | 0.164701 |
| Fly Ash | ZA-27 | 15 | 14.0 | 5,519,121 | 49.1 | 82.1 | 74,761 | 0.155876 |
| Fly Ash | ZA-27 | 20 | 28.1 | 1,925,934 | 39.9 | 71.8 | 32,125 | 0.141875 |
| Fly Ash | ZA-27 | 25 | 45.7 | 1,387,929 | 33.5 | 47.8 | 17,403 | 0.132702 |
| Fly Ash | Al | 15 | 5.7 | 5,759,688 | N/A | N/A | 61,648 | 0.096044 |
| Fly Ash | Zn | 15 | 22.9 | 5,025,497 | N/A | N/A | 35,496 | 0.199034 |
| Fly Ash | Sn | 15 | 35.7 | 4,992,757 | N/A | N/A | 17,294 | 0.184410 |
| — | Control 1(5) | 0 | 8.4 | 2,252,483 | 45.3 | 93.7 | 200,197 | 0.193019 |
| — | Control 2(6) | 0 | — | — | — | — | 37,200 | 0.15449 |

(1)Weight percentage of fly ash based on weight of metal.
(2)Young's Modulus of Elasticity.
(3)R-A: Rockwell A hardness measurement; R-B: Rockwell B hardness measurement.
(4)Fracture Stress.
(5)Pure ZA-27 powder with inherent $Al_2O_3$ film on each particle.
(6)Pure ZA-27 in stock ingot form.

What is claimed is:

1. A process for producing a metal composite from a low-cost earth product, comprising the steps of
   (a) mixing a metal matrix material with fly ash to obtain a homogeneous mixture;
   (b) heating said homogeneous mixture; and
   (c) forming said homogeneous mixture, thereby creating bonds between said fly ash and said metal matrix material to produce a metal composite.

2. The process according to claim 1, wherein said metal matrix material is selected from the group consisting of superplastic alloys, aluminum, tin and zinc.

3. The process according to claim 2, wherein said superplastic alloy is ZA-27.

4. The process according to claim 1, wherein the metal matrix material is in a powdered particle form and said forming step occurs continuously.

5. The process according to claim 4, wherein said homogeneous mixture is heated to the molten temperature of the metal matrix material during said heating step, thereby forming a heated mixture of said fly ash particles interdispersed betwen particles of the molten metal matrix material, said molten metal matrix material remaining in particle form as a result of an oxide film formed on said metal matrix material particles.

6. The process according to claim 4, wherein the homogeneous mixture has a fly ash content of 1 to 40% by weight based on the metal matrix material.

7. The process according to claim 5, wherein said forming step occurs continuously and comprises a process selected from the group consisting of chill block melt extraction, pressing, rolling, stamping and extruding.

8. The process according to claim 1, further comprising a first heating step prior to said mixing step to heat the metal matrix material in a solid ingot form to a molten liquid state, thereby facilitating said mixing step.

9. The process according to claim 8, wherein said forming step occurs continuously and is a process selected from the group consisting of hot isostatic forming of billets, casting, rolling, chill block melt extraction and extruding.

10. The process according to claim 9, further comprising the steps of heat treating said billet followed by a swaging, rolling, or other shaping process.

11. The process according to claim 1, wherein the metal matrix material is in a powdered form, the process further comprising the additional step of compressing the homogeneous mixture in a die at pressures from 10,000–50,000 lbs/in$^2$ before said heating and forming steps, thereby obtaining a compact.

12. The process according to claim 11, wherein the homogeneous mixture has a fly ash content of 1 to 40% by weight based on the metal matrix material.

13. A metal composite produced by:

(a) mixing a metal matrix material with fly ash to obtain a homogeneous mixture;

(b) heating said homogeneous mixture; and (c) forming said homogeneous mixture, thereby creating bonds between said fly ash and said metal matrix material to produce a metal composite which exhibits at least about a 14% reduction in specimen wear in a Koppers Brake Shoe Dry Wear Test with respect to said matrix material in pure form.

14. A metal composite produced from a low-cost earth product, comprising a metal matrix material and fly ash, said metal matrix material being a predominant component by weight in said metal composite, said composite exhibiting at least a 14% reduction in specimen wear in a Koppers Brake Shoe Dry Wear Test with respect to said matrix material in pure form.

15. The metal composite of claim 14, wherein said metal matrix material is selected from the group consisting of super-plastic alloys, aluminum, tin and zinc.

16. The metal composite of claim 14, wherein the metal matrix material is powdered, the metal matrix material and fly ash having particle sizes of between 1 and 100 μm.

17. The metal composite of claim 14, further comprising a metal matrix material to fly ash particle size ratio of 10/1 to 1/10.

18. The metal composite of claim 16, wherein said fly ash is present in amounts of between 1 to 40% by weight based on the metal matrix material.

19. The metal composite of claim 18, wherein said fly ash is present in amounts of between 5 to 25% by weight based on the metal matrix material.

20. The metal composite of claim 14, wherein said metal composite is produced from said metal matrix material initially in ingot form.

21. The metal composite of claim 15, wherein said superplastic alloy is ZA-27.

* * * * *